United States Patent [19]

Cataldo

[11] 4,112,826

[45] Sep. 12, 1978

[54] VARIABLE DISPLACEMENT RECIPROCATING PISTON MACHINE

[75] Inventor: Roy S. Cataldo, Birmingham, Mich.

[73] Assignee: General Motors Corporation, Detroit, Mich.

[21] Appl. No.: 792,668

[22] Filed: May 2, 1977

[51] Int. Cl.[2] ..... F01B 31/14; F02B 75/04

[52] U.S. Cl. ..... 92/13.1; 74/96; 92/13.7; 92/76; 92/149; 123/48 B; 123/78 F; 123/197 AC

[58] Field of Search ..... 123/18 R, 48 B, 78 E, 123/78 F, 197 AB, 197 AC; 58/58 B, 58 BB; 92/13.1, 13.7, 68, 76, 149; 74/25, 96

[56] References Cited

U.S. PATENT DOCUMENTS

| | | | |
|---|---|---|---|
| 1,591,208 | 7/1926 | Boerngen | 123/18 R |
| 1,744,542 | 1/1930 | Gough | 123/18 R |
| 1,885,323 | 11/1932 | Daryea | 123/58 BB |
| 1,968,470 | 7/1934 | Szombathy | 123/48 B |
| 2,263,561 | 11/1941 | Biermann | 123/48 B |
| 3,939,809 | 2/1976 | Rohs | 123/197 AB |

FOREIGN PATENT DOCUMENTS

| | | | |
|---|---|---|---|
| 494,173 | 9/1919 | France | 123/48 B |

*Primary Examiner*—Charles J. Myhre
*Assistant Examiner*—David D. Reynolds
*Attorney, Agent, or Firm*—Robert J. Outland

[57] ABSTRACT

Variable displacement reciprocating piston engine arrangements are disclosed wherein pistons drive a variable displacement oscillating rocker member connected with an oscillating lever that in turn drives a rotating shaft through a crank mechanism. The rocker member and oscillating lever are engaged at a sliding joint displaced from their spaced axes, forming an angular multiplier drive. The rocker member and its axis are movable to vary the piston stroke by changing the lever arm of the oscillating shaft connection with the rocker member, while at the same time the piston compression ratio is held constant or varied in a predetermined manner through adjustment of the piston positions by the same movement of the rocker member. Various drive and balancing arrangements are disclosed.

5 Claims, 6 Drawing Figures

VARIABLE DISPLACEMENT RECIPROCATING PISTON MACHINE

A great many mechanisms have been proposed in the prior art for use in making reciprocating piston machines, and particularly internal combustion engines, of variable displacement. It is believed that engines of this type could have worthwhile advantages over fixed displacement engines in the areas of both emission control and overall efficiency. To obtain these advantages, however, it is necessary that the mechanical linkage used to transmit power from the engine pistons to the output shaft be itself arranged to transmit the power in an efficient manner.

The present invention provides variable displacement mechanisms designed to provide efficient transmission of engine power from the pistons to an output shaft, while additionally providing the capability of varying piston displacement while maintaining constant piston compression ratio. If desired, the compression ratio may instead be varied in a predetermined manner as displacement is varied.

The mechanical arrangements include reciprocating pistons connected with a rocker member pivotable on an axis spaced from the axis of an oscillating lever with which it is engaged by a sliding coupling at a point distant from both axes. The rocker member with its pivot axis is laterally movable, with respect to the axis of the oscillating lever, so as to vary the piston stroke by changing the lever arm of the oscillating lever at its point of engagement with the rocker member. The same movement of the rocker member also changes the position of the piston stroke, thus correcting for the change in compression ratio which would otherwise occur and holding compression ratio constant or, if desired, varying it in a predetermined manner.

The oscillating lever may act as an output member or may be connected with a rotating output shaft through a crank mechanism or other suitable means. The total drive arrangement can utilize efficient revolute joints at all points of connection except at the coupling point between the oscillating lever and the rocker member where a sliding joint is used. However, the amount of sliding motion in this joint may be minimized so that high drive efficiency is maintained.

One possible arrangement utilizes a single oscillating lever to drive a pair of rocker members, each connected with pistons arranged in opposing fashion to provide inherent balance of the engine configuration. A four cylinder radial arrangement of the cylinder is preferred. Slightly greater motion of the sliding joint connections occurs in this arrangement due to repositioning of the oscillating lever relative to the rocker members which, if desired, could be avoided by use of dual interconnected oscillating levers each driving one of the rockers.

These and other features of the present invention will be more fully understood from the following description of certain preferred embodiments taken together with the accompanying drawings.

Figure 1:
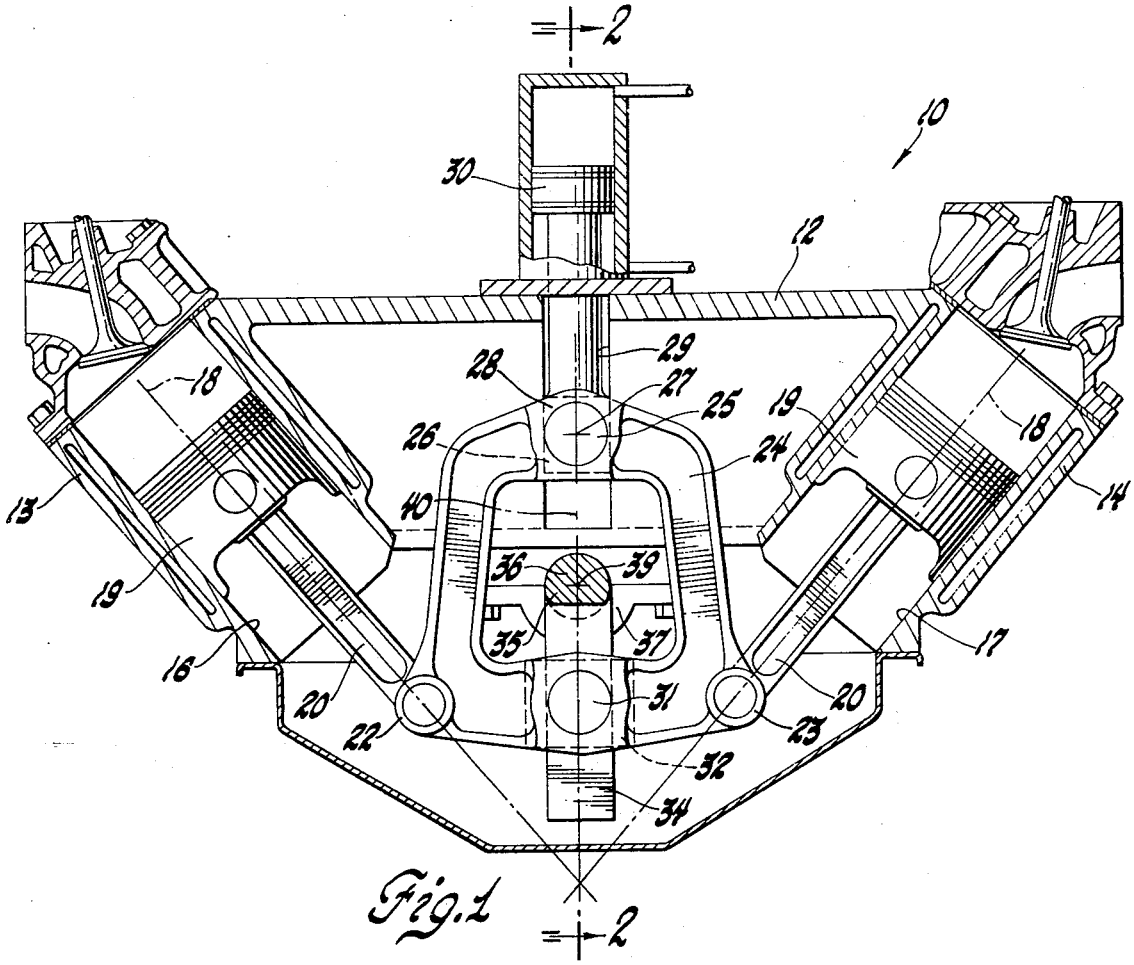
FIG. 1 is a transverse cross-sectional view of an engine formed according to the invention and showing details of the piston and rocker oscillating drive and variable displacement adjustment mechanism.
Figure 2:
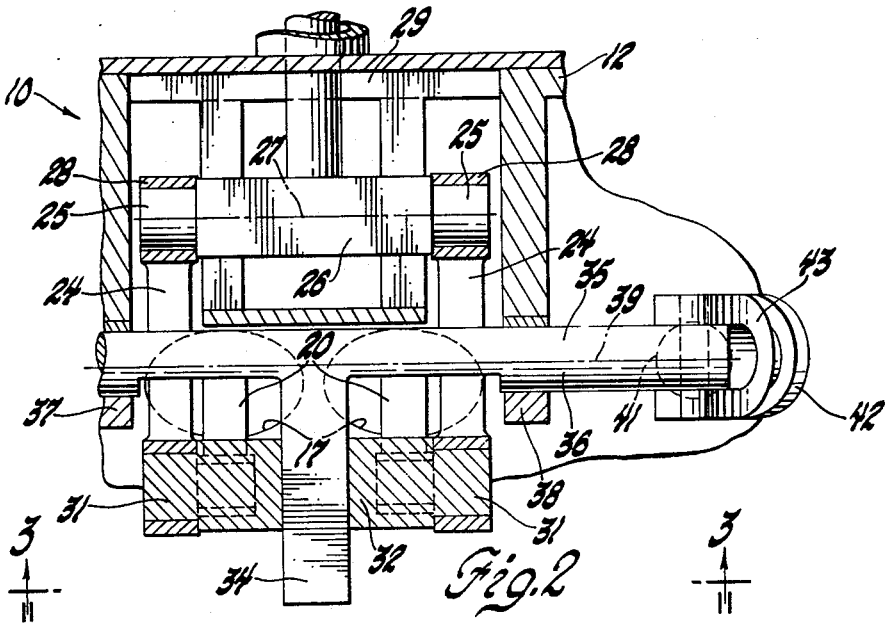
FIG. 2 is a vertical cross-sectional view taken in the plane indicated by the line 2—2 of FIG. 1.
Figure 3:
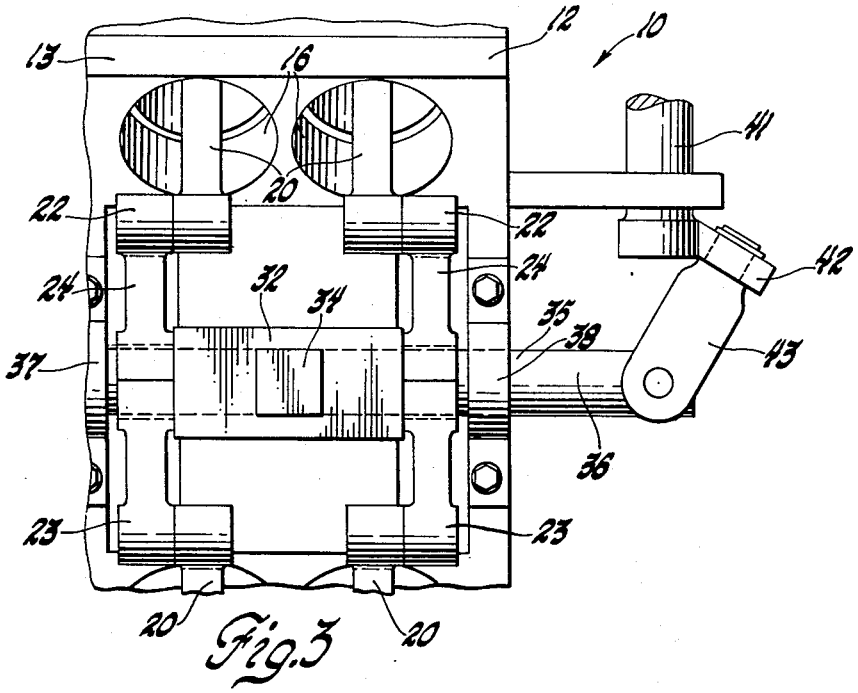
FIG. 3 is a partial bottom view as seen from the plane indicated by the line 3—3 of FIG. 2.

Referring now to the drawings in detail, FIGS. 1–4 illustrate an internal combustion engine generally indicated by numeral 10 and having a frame or block 12 including two cylinder banks 13, 14 defining cylinders 16, 17, respectively, arranged in laterally disposed pairs in V fashion with the opposite cylinders having intersecting axes 18 lying in a common plane. While the drawings show two such pairs of cylinders with two cylinders in each bank, it is to be understood that any number of multiple pairs of cylinders may be used. However, for a four stroke cycle engine, two pairs of cylinders are preferably utilized to provide even firing intervals.

Within the cylinders 16, 17 are pistons 19 which are connected by connecting rods 20 with the laterally spaced lower corners 22, 23 of more or less triangularly shaped rocker members 24. The rocker members 24 are pivotable on pins 25 supported on a rectangular guide member 26 and having an axis 27 through the upper corners 28 of the rockers and spaced equally from the lower corners 22, 23. Axis 27 extends normal to the planes of the cylinder axes 18 and forms a pivot axis for the rocker members 24. Guide member 26 is carried in a slot 29 formed by walls in the engine frame and means, such as hydraulic piston 30, are provided to adjust the position of the guide member 26 vertically in the slot, thereby moving the pins 25 and rocker members 24 upwardly or downwardly for purposes to be subsequently described.

Rocker members 24 engage, through coupler pins 31 and a bearing block 32, the radially extending lever arm portion 34 of a lever member 35, portion 34 being slidably received in the bearing block 32. The lever member 35 includes a longitudinally extending shaft portion 36 which is received in bearings 37, 38 that are carried in the engine frame 12 and support the lever member 35 for oscillation about a lever axis 39, which is parallel to, but spaced from, the rocker axis 27. Both axes 27 and 39 lie in a central vertical plane 40 spaced between and equidistant from the cylinders and passing through the intersection of their axes.

A rotatable output shaft 41 is also carried by the engine frame and disposed at right angles to the oscillatable shaft portion 36 of lever member 35. The two shafts are connected by an orthogonal crank mechanism which includes a crank arm 42 fixed on the end of the output shaft 41 and a clevis 43, which is rotatable attached to the end of crank arm 42 and extends angularly therefrom to a pivotal connection with the lever shaft 35 at the intersection of the axes of shafts 35 and 41.

The operation of the engine shown in FIGS. 1–4 is as follows:

Combustion of fuel-air mixtures in a conventional internal combustion engine cycle causes alternate reciprocation of the pistons 19 in their respective cylinders which in turn, through the connecting rods 20, causes oscillation of the rocker members 24 about their respective pivot pins 25. This oscillation acting through the slide bearing engagement of the rocker members with the lever member causes oscillation of lever member 35 which in turn, through the orthogonal crank mechanism, results in rotation of the output shaft 41.

It will be noted that the throw of the crank arm 42 and the angular relation of the clevis 43 to the crank arm determine the included angle through which the lever member 35 oscillates as the output shaft 41 rotates. In the disclosed arrangement, the lever member oscillates through an angle of about 120°; however, some other included angle of oscillation could be chosen, if desired. Since the rocker pin axis 27 of the rocker members 24 is spaced a greater distance away than is the axis 39 of lever member 35 from the coupler pins 31 which define the effective point of engagement between the rocker members and the lever arm portion 34 of member 35, the rocker member 24 oscillate through a smaller angle than does the lever member. Also, it should be apparent that the angle of oscillation of the rocker members and the relative positions of the rocker members and their connected pistons relative to the engine frame and cylinders determine the length of stroke of the engine pistons and their compression ratio. The stroke of the pistons will, of course, vary directly with the angle of oscillation of the rocker members. Also, the compression ratio will be increased if the rocker members and their attached pistons are moved upwardly, while holding the cylinders stationary, and will be decreased if the pistons and rocker members are moved downwardly, while holding the cylinders stationary.

Figure 4:
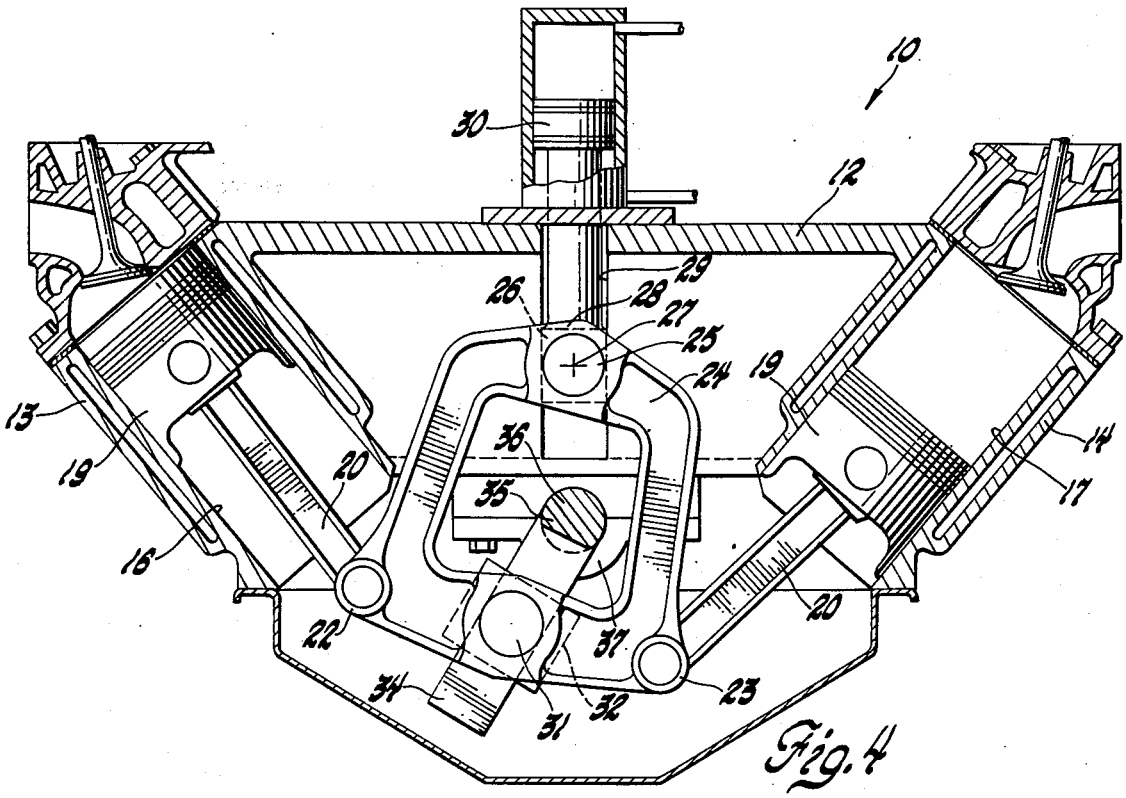
FIG. 4 is a transverse cross-sectional view similar to FIG. 1 but showing the engine mechanism at a different point in the operating cycle.

In the present arrangement, the rocker members are movable in a vertical direction, as shown in FIGS. 1 and 4 by adjustment of the guide member 26 vertically in the slot 29 through the attached hydraulic piston 30. This adjustment, however, has a dual effect. If, for example, the guide member 26 is moved upwardly in the slot 29, the rocker members 24 are raised and, at the same time, the effective lever arm of portion 34 of the lever member is shortened by upward movement of the coupler pins 31 which reduces the distance from these pins 31 to the axis 39 of the lever member. The result is that oscillation of the lever member through its fixed angle results in a lesser oscillation of the rocker members than before, thus reducing the stroke of the pistons 19. However, the upward movement of the rocker member also raises the positions of the pistons so that the piston strokes are effectively moved closer to the ends of their cylinders.

Thus with proper orientation and spacing of the various components, the upward movement of the rocker members reduces the piston clearance in the same proportion as the reduced angular motion of the rocker member caused by its upward movement, reduces the piston stroke. In this way, the compression ratio of the pistons may be made to remain constant, while the displacement is varied within predetermined limits. It should also be apparent that, if desired, the compression ratio may be altered in a predetermined fashion with respect to the change in engine displacement upon movement of the rocker member 24 by suitable selection of the dimensional and orientational variables of the mechanism.

It should be noted that the variable displacement capability of the engine heretofore described is made possible by a mechanism which utilizes high efficiency, revolute joints at all its drive connections, with the exception of the sliding bearing block 32 used between the rocker member 24 and oscillating lever member 35. However, the normal operational sliding motion of this bearing is limited in amount to the relative motion caused by the difference in effective lever arms of the lever member 35 and the rocker member 24. Thus the amount of sliding motion is small and the relative efficiency of the overall engine drive mechanism is accordingly maintained at a high level.

Figure 5:
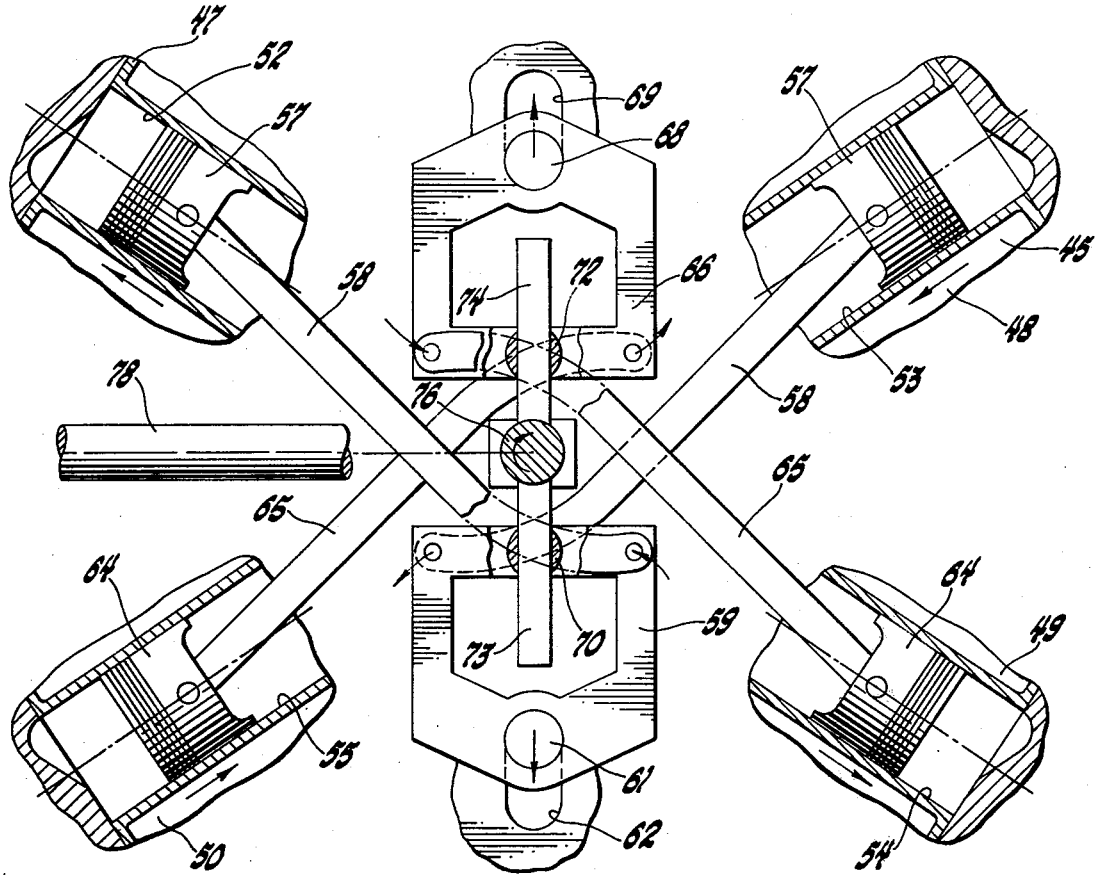
FIG. 5 is a schematic cross-sectional view of an alternative embodiment of engine formed according to the invention and providing complete balance of the reciprocating and oscillating components.

Referring now to FIG. 5 of the drawings, there is shown an alternative embodiment of variable displacement engine formed according to the invention. The arrangement of this engine has many similarities to that of the engine first described in that it has a frame 45 including cylinder banks 47, 48, 49 and 50 which define cylinders 52, 53, 54 and 55, respectively, arranged in generally radial configuration, with the opposing cylinders coaxially arranged. Pistons 57 in the upper pair of cylinders 52, 53 are connected through connecting rods 58 with opposite corners of a rocker member 59 pivotable on a pivot pin 61 that is vertically adjustable in a slot 62 in the engine frame in a manner similar to the first described embodiment. Pistons 64 in the lower cylinders 54, 55 are connected by connecting rods 65 to the opposite corners of a rocker member 66 which is pivotable about a pivot pin 68 that is in turn slidably movable in a slot 69 provided in the engine frame.

In the FIG. 5 embodiment, the rocker members are connected by slider bearings 70, 72 with oppositely extending lever arm portions 73, 74 of an oscillatable lever member 76. Lever member 76 is supported in the engine frame and connected to a rotatable output shaft 78 through an orthogonal crank mechanism, not shown, similar to the crank mechanism 42, 43 used in the first described engine embodiment. The arrangement differs from that first described in that the rocker members 59, 66 are inverted with respect to the positions of their connected pistons and the oscillation axis of the lever member 76 lies further from the axes of pivot pins 61, 68 than do the engagement points of their respective rocker members with the lever member. This requires the cross connection of the connecting rods to obtain the desired action subsequently described.

In operation, reciprocating motion of the pistons causes oscillation of the rocker members 59, 66 which in turn oscillate the lever member 76 and rotate the output shaft 78. The arrangement differs from that previously described in that outward adjustment of the rocker members increases, rather than decreases the piston stroke, due to the repositioning of the lever shaft axis on the opposite sides of the slider bearings 70, 72 from their respective pivot pins 61, 68. In addition, the arrangement of FIG. 5 causes somewhat increased sliding motion in the slider bearings 70, 72, as opposed to that in the first described embodiment, because of the change in positions of the respective axes as mentioned above.

Figure 6:
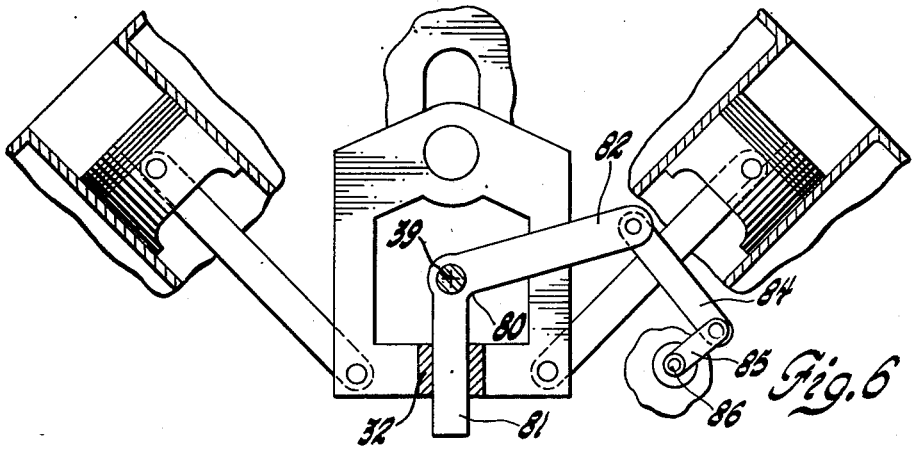
FIG. 6 is a schematic cross-sectional view of another embodiment of engine having a different form of crank than that of the FIG. 1 embodiment.

The embodiment of FIG. 6 is generally similar to that of FIGS. 1–4 and like numerals have been used for like parts. It differs however in the construction of the lever member and its connection to the output shaft.

In this embodiment, lever member 80 includes a first lever arm portion 81 which engages the bearing block 32, a second lever arm portion 82, integral with and extending angularly from the pivot axis 39 between the portions, connects with a link 84 which in turn is pinned to a crank arm 85 on the output shaft 86. Thus the FIG. 6 embodiment is distinguished by the use of the planar linkage and parallel crank in place of the orthogonal crank arrangement of the FIGS. 1–4 embodiment.

While the invention has been described by reference to certain embodiments chosen for purposes of illustration, it should be understood that numerous changes in addition to those indicated could be made within the scope of the inventive concepts embodied in this disclosure and accordingly it is intended that the invention not be limited, except in accordance with the language of the following claims.

What is claimed is:

1. The combination in a reciprocating piston machine of a variable displacement mechanism whereby piston displacement may be varied at will while maintaining a predetermined range of compression ratios, said machine comprising a frame defining at least one cylinder having an axis, a piston disposed in the cylinder and reciprocable on the axis thereof, a rocker member pivotable in a plane parallel to the cylinder axis about a rocker axis normal to said plane, said rocker member having a point laterally spaced from the rocker axis and connected with the piston by a connecting rod, a lever member oscillatable about a lever axis parallel with and spaced from the rocker axis, said lever member having a lateral lever arm portion slidably engaging the rocker member at a point spaced from both said rocker and lever axes, and means for laterally shifting the rocker axis toward and away from the lever axis to vary the effective length of said lever arm portion at its engagement point with the rocker member, while at the same time moving the rocker member in a direction to vary the clearance of the piston in its cylinder in a ratio correlated with the variation in the effective lever arm length such that the piston displacement is varied while maintaining the piston compression ratio in a desired range.

2. The combination of claim 1 and further comprising a rotatable output shaft drivingly connected with said oscillatable lever member by means effective to rotate said output shaft upon repetitive oscillation of said lever member.

3. The combination in a reciprocating piston machine of a variable displacement mechanism whereby piston displacement may be varied at will while maintaining a predetermined range of compression ratios, said machine comprising a frame defining at least one pair of laterally spaced cylinders arranged in V configuration and having intersecting axes lying in a common plane.

pistons reciprocably disposed in the cylinders, a rocker member pivotable about a rocker axis normal to the cylinder plane, said rocker axis lying in a central plane spaced equally between the cylinders and passing through the intersection of their axes, said rocker member having points spaced laterally from one another and from said rocker axis and respectively connected with the pistons by connecting rods, a lever member oscillatable about a lever axis parallel with and spaced from the rocker axis and lying in said central plane, said lever member having a lateral lever arm portion slidably engaging the rocker member at a point spaced from both said rocker and lever axes, and means for laterally shifting the rocker axis toward and away from the lever axis to vary the effective length of the lever arm portion at its engagement point with the rocker member, while at the same time moving the rocker member in a direction to vary the clearance of its connected pistons in their respective cylinders in a ratio correlated with the variation in the effective lever arm length such that the piston displacement is varied while maintaining the piston compression ratio in a desired range.

4. The combination of claim 3 wherein said machine frame defines two pairs of cylinders, said cylinders being arranged in radially opposed configuration, each of said cylinder pairs being connected with a separate rocker member and said rocker members engaging oppositely radially extending lever arm portions of the same lever member, whereby the reciprocating and oscillating portions of said machine are balanced under all operating conditions.

5. The combination of claim 4 and further comprising a rotatable output shaft drivingly connected with said lever member by crank means effective to rotate said output shaft upon repetitive oscillation of said lever shaft through a predetermined angle.

* * * * *